US009018850B2

(12) United States Patent
Nguyen et al.

(10) Patent No.: US 9,018,850 B2
(45) Date of Patent: Apr. 28, 2015

(54) SAFETY FLASHING DETECTOR FOR TRAFFIC LAMPS

(75) Inventors: Truong-Khoa Nguyen, Lachine (CA); Benoit Essiambre, Lachine (CA); Christian Poirier, Lachine (CA)

(73) Assignee: GE Lighting Solutions, LLC, Cleveland, OH (US)

( * ) Notice: Subject to any disclaimer, the term of this patent is extended or adjusted under 35 U.S.C. 154(b) by 983 days.

(21) Appl. No.: 12/979,605

(22) Filed: Dec. 28, 2010

(65) Prior Publication Data

US 2012/0161641 A1 Jun. 28, 2012

(51) Int. Cl.
*H05B 41/16* (2006.01)
*H05B 33/08* (2006.01)

(52) U.S. Cl.
CPC ..... *H05B 33/089* (2013.01); *H05B 33/0884* (2013.01)

(58) Field of Classification Search
USPC ..... 315/247, 185 S, 224, 291, 307–312
See application file for complete search history.

(56) References Cited

U.S. PATENT DOCUMENTS

| | | | | |
|---|---|---|---|---|
| 4,376,910 | A | 3/1983 | Peslier | |
| 5,327,123 | A | 7/1994 | Heimann et al. | |
| 5,387,909 | A | 2/1995 | Neel et al. | |
| 6,184,799 | B1 | 2/2001 | Jinno et al. | |
| 6,243,644 | B1 | 6/2001 | Dengler | |
| 6,369,704 | B2 | 4/2002 | Hilleary | |
| 6,583,731 | B2 | 6/2003 | Chan et al. | |
| 7,129,856 | B2 | 10/2006 | Hering et al. | |
| 7,692,912 | B2 * | 4/2010 | Fiebrich et al. | 361/93.9 |
| 8,035,315 | B2 * | 10/2011 | Zhao et al. | 315/299 |
| 8,084,960 | B2 * | 12/2011 | Kuo et al. | 315/297 |
| 8,294,379 | B2 * | 10/2012 | Liu et al. | 315/224 |
| 8,310,169 | B2 * | 11/2012 | Yu | 315/246 |
| 8,330,705 | B2 * | 12/2012 | Ye et al. | 345/102 |
| 8,344,659 | B2 * | 1/2013 | Shimomura et al. | 315/307 |
| 8,405,325 | B2 * | 3/2013 | Inoko et al. | 315/360 |
| 8,462,003 | B2 * | 6/2013 | Ng et al. | 340/635 |
| 8,476,842 | B2 * | 7/2013 | Chuang et al. | 315/291 |
| 2002/0000911 | A1 | 1/2002 | Hilleary | |
| 2006/0125418 | A1 | 6/2006 | Bourgault | |
| 2008/0088478 | A1 | 4/2008 | Shillman et al. | |

FOREIGN PATENT DOCUMENTS

| | | | |
|---|---|---|---|
| EP | 0 268 060 | B1 | 10/1987 |
| EP | 0 453 643 | B1 | 2/1990 |
| EP | 0 565 992 | B1 | 4/1993 |
| EP | 1 546 464 | B1 | 9/2003 |
| EP | 2012559 | A2 | 1/2009 |
| EP | 206095 | A2 | 7/2009 |

* cited by examiner

OTHER PUBLICATIONS

Search Report and Written Opinion from corresponding EP Application No. 11193922.9-2206 dated Oct. 29, 2012.

*Primary Examiner* — Tuyet Thi Vo
(74) *Attorney, Agent, or Firm* — Fay Sharpe LLP

(57) ABSTRACT

A safety flashing detector that suitably detects unintentional flashing of the LED light engine in a traffic lamp is provided. The LED light engine may flash unintentionally when there are failures (hardware or software) inside a traffic lamp. In certain embodiments, unintentional flashing may be detected using a current sensor. If unintentional flashing is detected, the flashing detector may activate and shut down the LED light engine to remove the hazardous failure and eventually triggers the fuse blowout circuit. Hardware circuitry is suitably employed for both reliability and safety purposes, but software may also be employed.

12 Claims, 4 Drawing Sheets

SAFETY FLASHING DETECTOR FOR TRAFFIC LAMPS

BACKGROUND

The present exemplary embodiments relate generally to signal lighting. They find particular application in conjunction with Light Emitting Diode (LED) traffic lamps, and will be described with particular reference thereto. However, it is to be appreciated that the present exemplary embodiments are also amenable to other like applications.

Traffic signals are typically disposed along roads to control the flow of traffic and/or make intersections more visible. Traffic signals may also be employed to provide warning to motorists, such as at railroad crossings. Traffic signals may include one or more traffic lamps, each having one or more light sources, such as LEDs, disposed therein. Typical colors used in traffic lamps include red, yellow and green.

One problem with traditional LED traffic lamps is that it is generally difficult to diagnosis failures. Namely, some failures may occur due to faults in the operating parameters of traffic lamps. There are some failure modes within a traffic signal that can create unsafe situations for the traffic system. One such failure mode is when the signal is flashing, but it should be ON or OFF continuously.

The present disclosure contemplates new and improved systems and/or methods for remedying this and other problems.

BRIEF DESCRIPTION

Various details of the present disclosure are hereinafter summarized to provide a basic understanding. This summary is not an extensive overview of the disclosure and is intended neither to identify certain elements of the disclosure, nor to delineate the scope thereof. Rather, the primary purpose of the summary is to present certain concepts of the disclosure in a simplified form prior to the more detailed description that is presented hereinafter.

In one embodiment, an LED traffic lamp is provided. The LED traffic lamp generally includes at least one LED light engine that generates light for the traffic lamp and an LED current sense circuit. The LED current sense circuit may be configured to monitor the current through the LED light engine and feed one or more output signals to a safety flashing detector and/or a fuse blow out circuit. The safety flashing detector may be configured to detect one or more abnormal fluctuations in the LED light engine current and/or frequency when such current and/or frequency should be steady at a predetermined threshold and to shut down the LED light engine.

In another embodiment, an LED traffic lamp is provided. The LED traffic lamp generally includes at least one LED light engine that generates light for the traffic lamp and an LED voltage control circuit. The LED voltage control circuit may be configured to control the power to the LED light engine to ensure proper operation of the traffic lamp where the traffic lamp is ON when it should be ON, OFF when it should be OFF and/or steady when it should be steady and wherein when unintentional flashing and/or failures within the traffic lamp lead to a wrong signal state. The LED voltage control circuit may be further configured to turn OFF the LED light engine and place the traffic lamp in a safe state.

In yet another embodiment, an LED traffic lamp is provided. The LED traffic lamp generally includes at least one LED light engine that generates light for the traffic lamp and an LED current sense circuit. The LED current sense circuit may be configured to monitor the current through the LED light engine and feed one or more output signals to a safety flashing detector and/or a fuse blow out circuit. The safety flashing detector may be configured to detect one or more abnormal fluctuations in the LED light engine current and/or frequency when such current and/or frequency should be steady at a predetermined threshold and to shut down the LED light engine. The LED traffic lamp may also include at least one LED light engine that generates light for the traffic lamp and an LED voltage control circuit. The LED voltage control circuit may be configured to control the power to the LED light engine to ensure proper operation of the traffic lamp where the traffic lamp is ON when it should be ON, OFF when it should be OFF and/or steady when it should be steady and wherein when unintentional flashing and/or failures within the traffic lamp lead to a wrong signal state. The LED voltage control circuit may be further configured to turn OFF the LED light engine and place the traffic lamp in a safe state.

BRIEF DESCRIPTION OF THE DRAWINGS

The following description and drawings set forth certain illustrative implementations of the disclosure in detail, which are indicative of several exemplary ways in which the various principles of the disclosure may be carried out. The illustrative examples, however, are not exhaustive of the many possible embodiments of the disclosure. Other objects, advantages and novel features of the disclosure will be set forth in the following detailed description of the disclosure when considered in conjunction with the drawings, in which.

DETAILED DESCRIPTION

Figure 1:
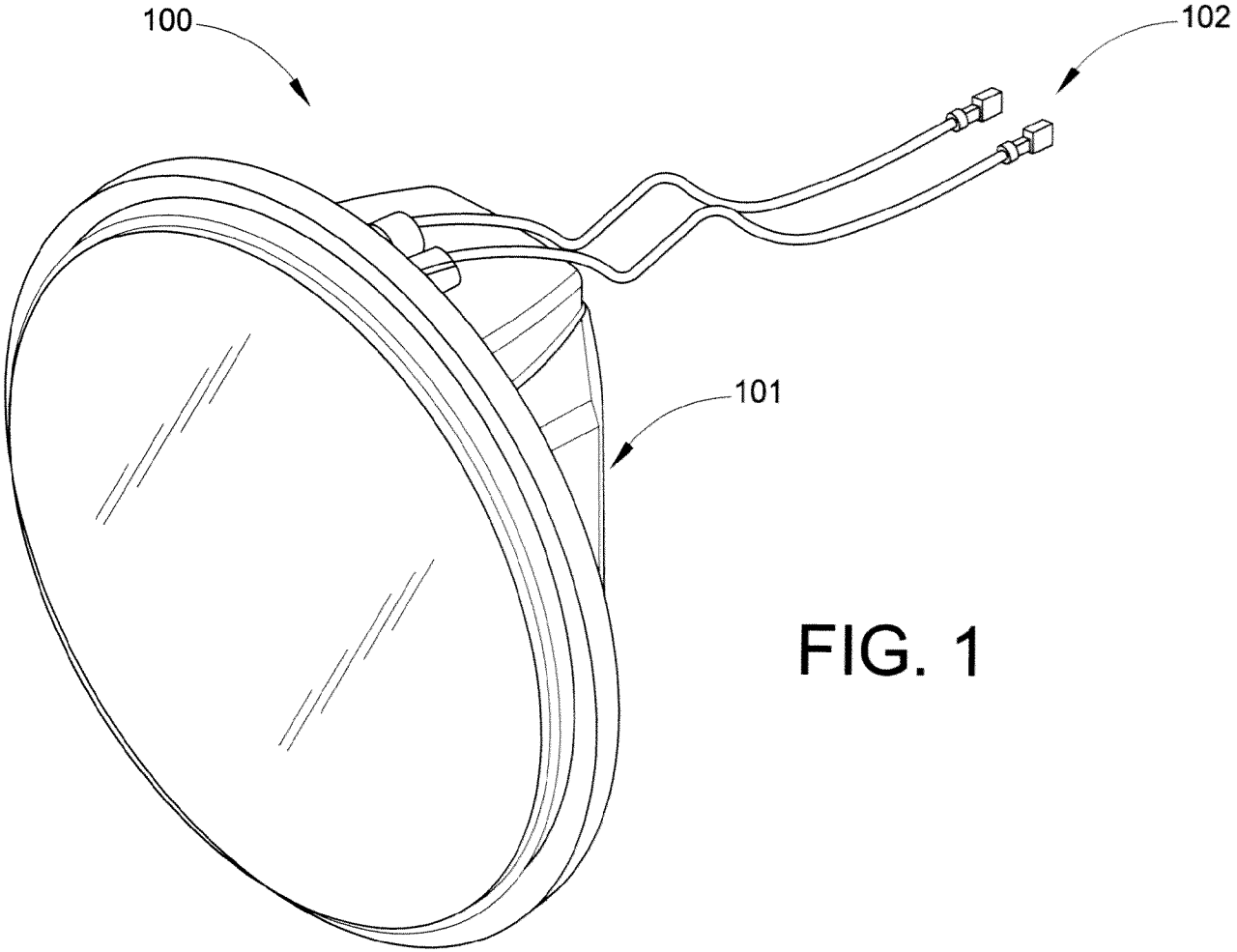
FIG. 1 is a perspective view of a traffic lamp.

One or more embodiments or implementations are hereinafter described in conjunction with the drawings, where like reference numerals are used to refer to like elements throughout, and where the various features are not necessarily drawn to scale.

With reference to FIG. 1, an illustrative embodiment of a tramp lamp 100 according aspects of the present disclosure is provided. The illustrated traffic lamp 100 is typical of what one would find overhanging an intersection. Other embodiments of the traffic lamp 100 are, however, contemplated. The traffic lamp 100 includes a housing 101 and one or more connectors 102. The connectors 102 are provisioned to receive electrical power and, in certain embodiments, control commands from an external source (not shown), such as a traffic controller. Disposed within the housing 101, the traffic lamp 100 includes traffic lamp electronics (shown in FIG. 2 as reference numeral 103) for monitoring operating parameters.

Figure 2:
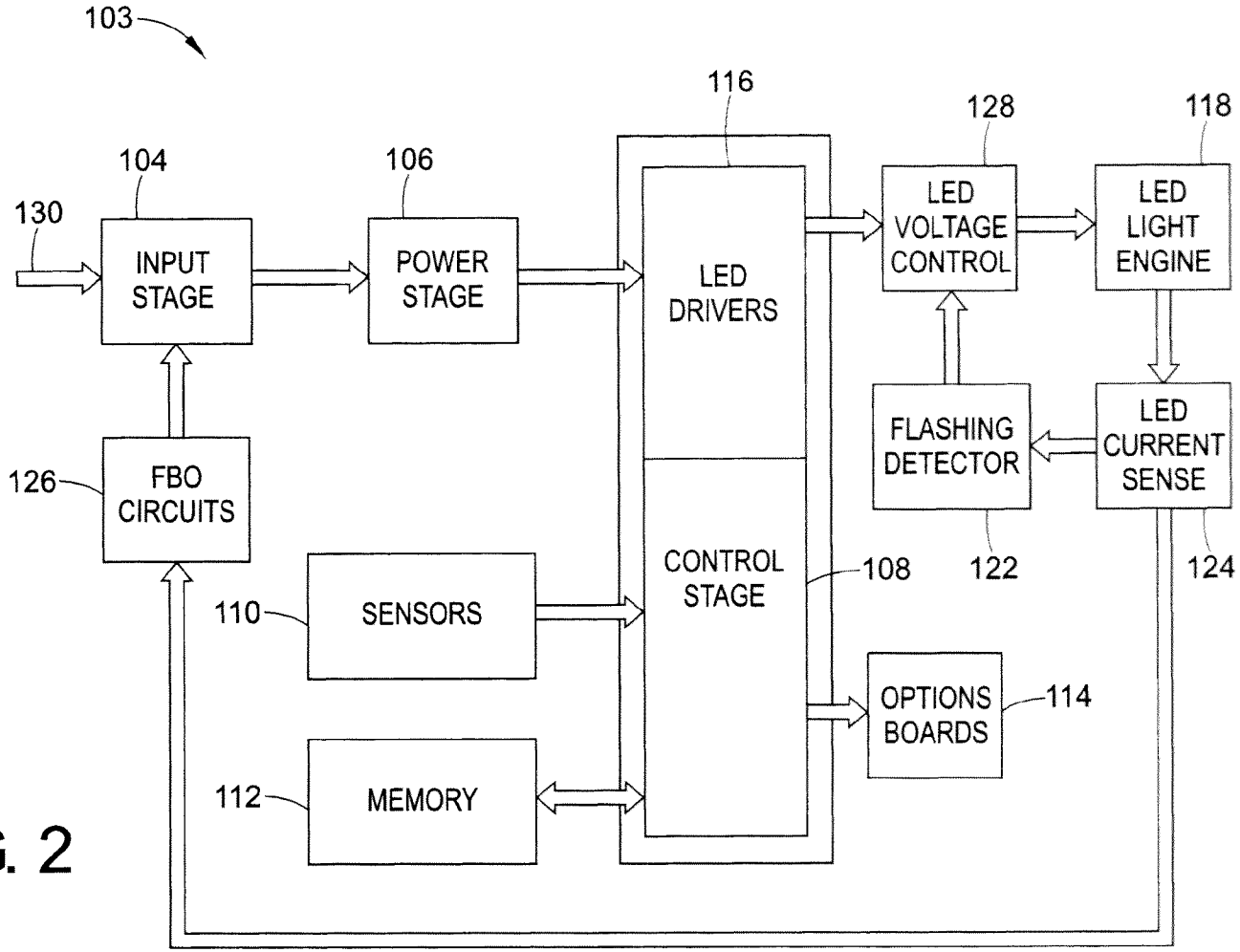
FIG. 2 is a block diagram of the electronics for the traffic lamp, incorporating a safety flashing detector according to aspects of the present disclosure.

With reference to FIG. 2, the traffic lamp electronics 103 is shown. The traffic lamp electronics 103 generally consists of an input stage 104, a power stage 106, a control stage 108, a number of onboard accessories such as one or more sensors 110, memory 112, and one or more options boards 114, one or more LED drivers 116, an LED light engine 118, a number of hardware safety circuits such as a safety flashing detector 122, an LED current sense circuit 124, and fuse blowout (FBO) circuits 126, and an LED voltage control circuit 128.

The input stage 104 may receive power from an external power source and distribute the power to the constituent components of the traffic lamp electronics 103. The input voltage to the input stage 104 is typically an alternating current (AC) voltage, but it is contemplated that the received input voltage may be a direct current (DC) voltage. Further, the input voltage typically ranges from 0V to 265V and/or the input frequency typically ranges from 0 Hz to 150 Hz, insofar as the received input voltage is AC. The input stage 104 may include one or more of high voltage surge protection, input fuse protection, electromagnetic interference (EMI) filters, a full wave bridge rectifier, and the like. In certain embodiments, the input stage 104 may include a power factor correcting power supply.

The power stage 106 takes the output from the full wave bridge rectifier (not shown) of the input stage 104 and converts it to a compatible DC level for the control stage 108, the LED drivers 116, and other constituent components of the traffic lamp electronics 103.

The LED light engine 118 may generate light for the traffic lamp 100. Suitably, the LED light engine 118 generally includes one or more LEDs. The LED light engine 118 may be selected to control Correlated Color Temperature (CCT), Color Rendering Index (CRI) and other like characteristics of light. In certain embodiments, the color of LED light engine 118 may be one or more of yellow, green and red.

The control stage 108 controls the LED drivers 116 with respect to turning the LED light engine 118 ON or OFF, as well as dimming the LED light engine 118 based on a set of parameters, such as input voltage amplitude, temperature, LED nominal current, dimming options, etc. Besides controlling the LED drivers 116 and the LED light engine 118, the control stage 108 also has the capability of controlling auxiliary options boards. When necessary, the control stage 108 can disable the LED light engine 118 if it detects one or more failures in the traffic lamp electronics 103, and the FBO circuits 126 will blow out the fuse.

The control stage 108 may further instruct the LED driver 116 as to the proper output current to provide to the LED light engine 118, so as to account for degradation factors. Degradation factors relate to the light output of the LED light engine 118 and may include one or more of operating time of the LED light engine 118, temperature inside the traffic lamp 100, and the like. As to traffic controller dimming (when enabled), the light output of the LED light engine 118 may vary with the input voltage. The control stage 108 also monitors the traffic signal operating conditions (e.g., temperature, voltage, current, etc.), communicates with external devices (e.g., the memory 112, the options boards 114, and others), and performs any digital or analog functions within the traffic lamp electronics 103. The control stage 108 may include a digital/electronic processor, such as a microprocessor, microcontroller, graphic processing unit (GPU), and the like. In such embodiments, the controller suitably executes instructions stored on a memory (not shown) in the traffic lamp electronics 103. In other embodiments, the memory is local to the control stage 108 and one of ROM, EPROM, EEPROM, Flash memory, and the like.

The sensors 110 generally measure one or more operating parameters, such as input voltage, input frequency, and the like, of the traffic lamp 100. However, suitably the sensors 110 measure at least the operating (i.e., internal) temperature of the traffic lamp 100. Temperature is an important operating parameter of the traffic lamp 100. That is, temperature may affect the light output of the light sources 118. In certain embodiments, the sensors 110 include one or more of passive and/or active electronic circuits, thermistors, temperature sensors, and the like.

The memory 112 generally stores data relating to LED degradation compensation. The memory 112 also contains the operating parameters of the traffic lamp 100 such as nominal LED current, dimming options, operating voltage, options boards, etc. The memory 112 can also be responsible for logging the conditions of the traffic lamp electronics 103.

The options boards 114 suitably expand the functionality of the traffic lamp 100. The options boards 114 may include the appropriate hardware to heat the traffic lamp 100, simulate a dummy load, interface current pulsers with traffic controllers, and the like. However, other options boards are equally amenable.

The traffic lamp electronics 103 also includes hardware safety circuits external to the control stage 108 that protect the system when hazardous failures occur within the traffic lamp electronics 103, such as failure(s) from the power stage 106, the control stage 108, the LED drivers 116, the LED light engine 118 and/or the LED voltage control circuit 128. In particular, the LED current sense 124 monitors the light engine conditions and feeds an output signal to the safety flashing detector 122 and/or the FBO circuits 126. In one embodiment, the LED voltage control circuit 128 may be configured to control the power to the LED light engine 118 to ensure proper operation of the traffic lamp 100 where the traffic lamp 100 is ON when it should be ON, OFF when it should be OFF and/or steady when it should be steady. Thus, when unintentional flashing and/or failures within the traffic lamp 100 lead to a wrong signal state, the LED voltage control circuit 128 may turn OFF the LED light engine 118 and place the traffic lamp 100 in a "safe" state.

In operation, the safety flashing detector 122 may detect one or more abnormal fluctuations in the LED current and/or frequency when such current and/or frequency should be steady. In that case, the safety flashing detector 122 may turn off the LED voltage control circuit 128 so as to disable the power path to the LEDs and thus shut down the LED light engine 118. Such action will generally have the effect of stopping the current from flowing through the LEDs and thus preventing the traffic lamp 100 from flashing when it should be continuously ON or OFF. Thus, it is important to be sure the fluctuation in the current is real before the deactivation of the LED light engine 118 process starts.

The FBO circuits 126 typically blow out the input fuse and permanently disconnect the traffic lamp 100 from the traffic controller if there is no more current flow through the LED light engine 118, when the input voltage is within its normal operating range.

The control stage 108 directly controls the current level in the LED light engine 118 through the LED drivers 116. If there are failures in the software or internal hardware of the control stage 108 and/or the LED drivers 116 such that the LED current fluctuates at a low frequency, the traffic lamp 100 may become a flashing signal when it should be continuously ON. The flashing detector 122 may remove this condition if it ever occurs and place the traffic lamp 100 in a safe state.

Figure 3:
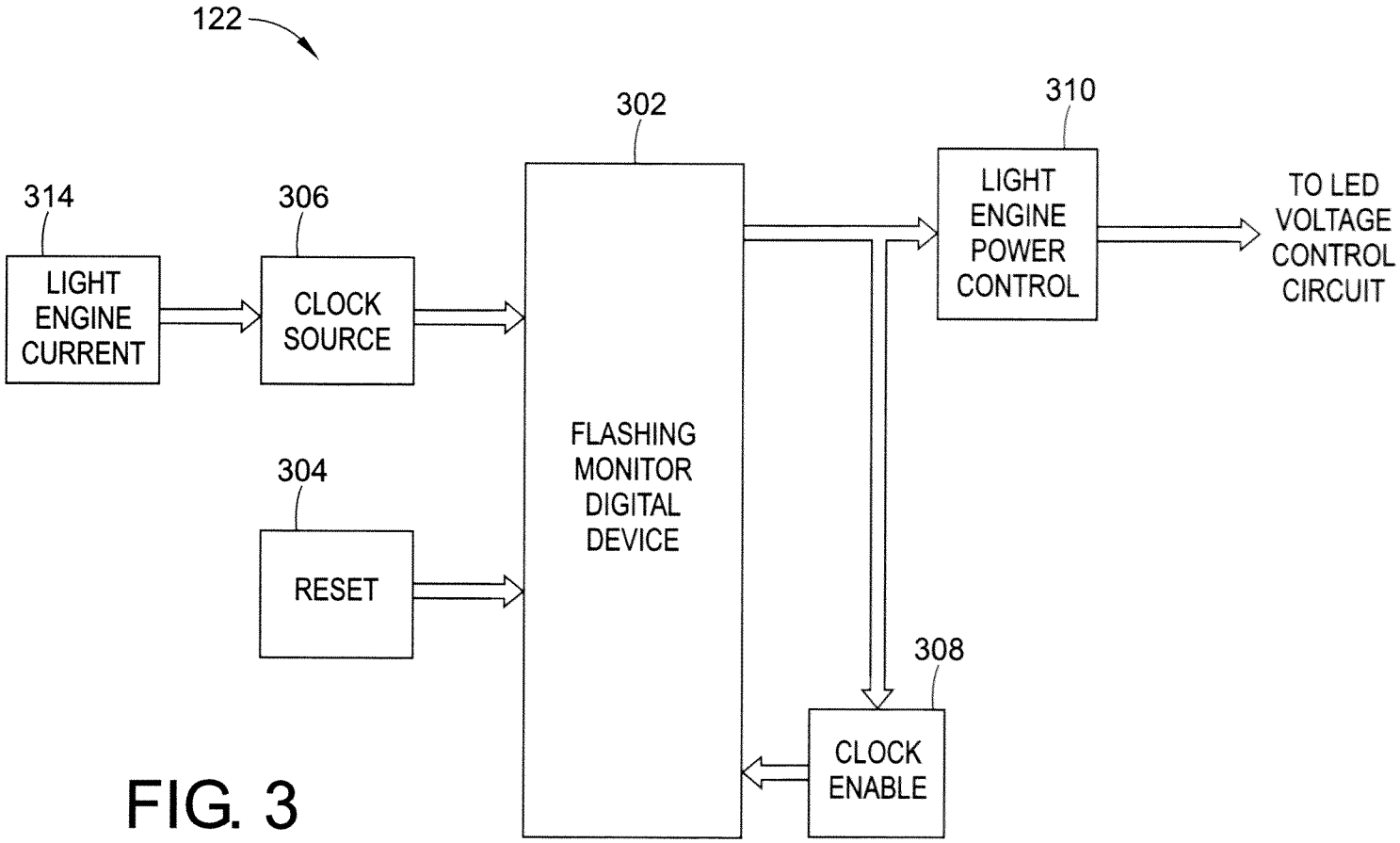
FIG. 3 is a block diagram of the safety flashing detector according to aspects of the present disclosure.

With reference now to FIG. 3, the safety flashing detector 122 for a traffic lamp is shown in greater detail. The safety flashing detector 122 for a traffic lamp generally comprises a digital device such as a flashing monitor 302, a reset circuit 304, a clock source 306, a clock enable circuit 308, and an LED light engine power control circuit 310.

The digital device 302 generally comprises a microcontroller, a counter, and/or a divider. The digital device 302 may be described as the heart of the flashing detector 122. It generally monitors the amplitude and/or frequency of the light engine current 314 as received from the LED current sense circuit 124, disables the power path to the LED light engine 118 to turn OFF the LED light engine when abnormal fluctuations in the LED current 314 are detected.

The reset circuit 304 is a power-on reset, which acts as an input to the digital device 302 to initialize and ensure proper operation at power up. That is, the supply voltage (e.g., 5V) is the input signal to the reset circuitry.

In one embodiment, the digital device 302 comprises a decade counter. A decade counter (or mod-counter) is one that counts in decimal digits, rather than binary. A decade counter may have each digit binary encoded (that is, it may count in binary-coded decimal) or other binary encodings. The reset signal ensures a high output level on Q0 or the first count of the decade counter.

In another embodiment, the digital device 302 comprises a microcontroller 302. In that case, the power-on reset signal ensures proper hardware and software initialization for the microcontroller at power up.

Figure 4:
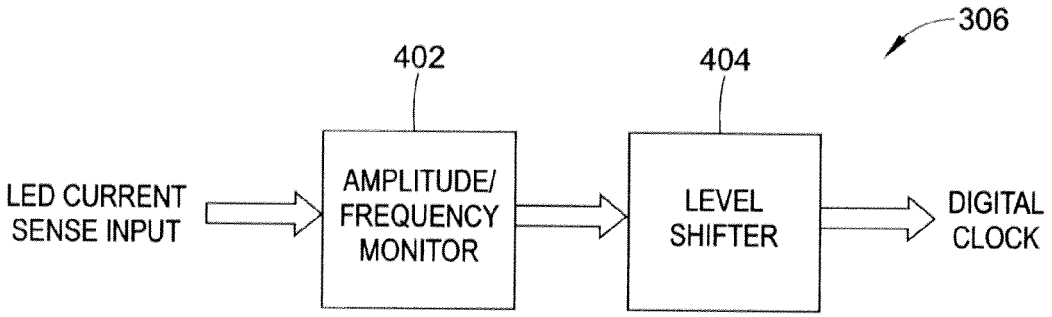
FIG. 4 is a block diagram of the flashing detector clock source according to aspects of the present disclosure.

The clock source 306 typically converts the LED current 214 into a digital clock for the digital device 302. As shown in FIG. 4, the clock source 306 typically includes an amplitude/frequency monitor circuit 402 and a level shifter circuit 404. The amplitude/frequency monitor circuit helps to ensure that the correct LED current level and/or frequency is met before producing an output signal. The level shifter circuit 404 takes the output signal from the amplitude/frequency monitor circuit 402 and translates the higher amplitudes to a compatible voltage level that is safe for the digital device 302 (e.g., 5V). The frequency from the LED current sense circuit 124 is directly proportional to the clock signal that feeds the digital device 302. When the LED light engine current amplitude and/or frequency fluctuates below a predetermined threshold (e.g., 50 mA in amplitude, 120 Hz in frequency), the digital device 302 initiates the flashing detection process based on the "flashing" frequency of the faulty traffic signal.

Figure 5:
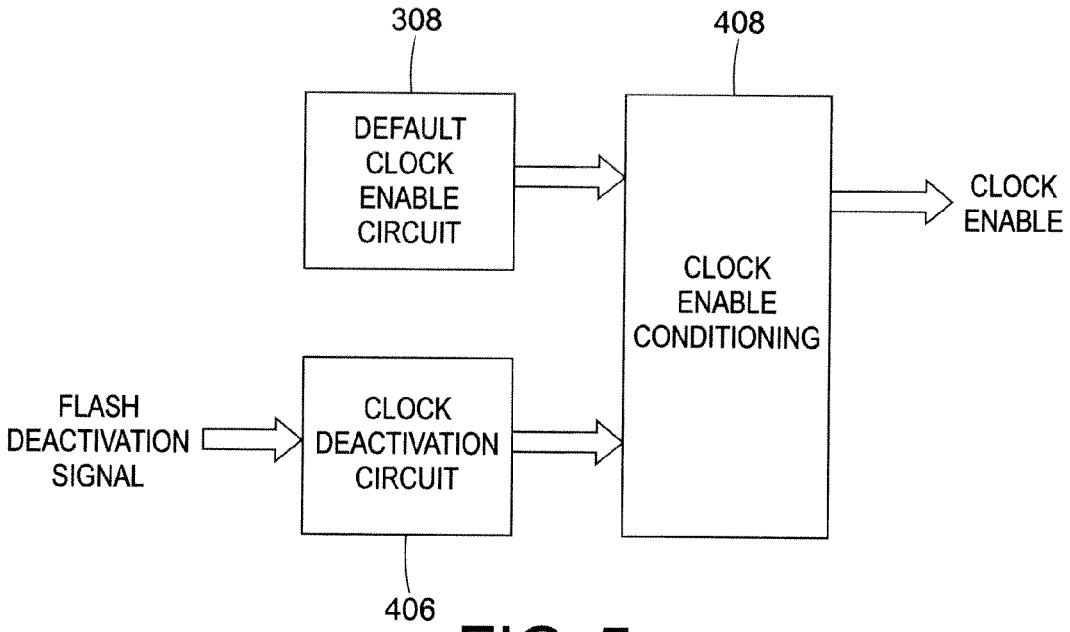
FIG. 5 is a block diagram of the flashing detector clock enable according to aspects of the present disclosure.

With reference to FIG. 5, when powered up, a clock enable conditioning circuit 408 may select the default clock enable circuit 308 to allow the digital device 302 to advance to the next output from Q0 (Q1, Q2 . . . etc) on the rising and/or falling edge of the clock signal. When the "flashing detection" output (e.g., Q4) from the digital device 302 is active, a clock deactivation circuit 406 may take over and deactivate the clock enable signal through the clock conditioning circuit 408. The digital device 302 may hold its last output level permanently regardless of the clock input. To avoid random noise pickup and to reduce the sensitivity of the system, a predetermined number of flashes (e.g., 2 flashes) may be allowed before the digital device 302 enable the clock deactivation circuit 406 to disable the clock enable signal input to the digital device 302 and "latch" the flashing detection output (i.e., output Q4) of the digital device 302 permanently. A latch is an example of a bi-stable multi-vibrator, that is, a device with exactly two stable states. These states are high-output and low-output. A latch has a feedback path, so information can be retained by the device. Therefore, latches can be memory devices, and can store one bit of data for as long as the device is powered. As the name suggests, latches are used to "latch onto" information and hold in place.

Once the digital device output is latched, the flashing detection output (Q4) signal from the digital device 302 deactivates the power path to the LED light engine 118 through the light engine power control 310. When the power path of the LED light engine 118 is disabled, current will stop flowing into the LEDs, whereby the LED light engine 118 will turn OFF. Once the LED light engine is OFF, the FBO circuits 126 will activate and blow out the input fuse.

The disclosure has been made with reference to preferred embodiments. Obviously, modifications and alterations will occur to others upon reading and understanding the preceding detailed description. It is intended that the preferred embodiments be construed as including all such modifications and alterations insofar as they come within the scope of the appended claims or the equivalents thereof.

The invention claimed is:

1. An LED traffic lamp comprising:

at least one LED light engine that generates light for the traffic lamp; and an LED current sense circuit that is configured to monitor the current through the LED light engine and feed one or more output signals to a safety flashing detector and a fuse blow out circuit, wherein the safety flashing detector is configured to detect one or more abnormal fluctuations in the LED light engine current or frequency when such current or frequency should be steady at a predetermined threshold and to shut down the LED light engine.

2. The traffic lamp of claim 1, further comprising a control stage that is configured to control a current level in the LED light engine through one or more LED drivers.

3. The traffic lamp of claim 1, wherein the safety flashing detector further comprises a digital device, a reset circuit, a clock source, a clock enable circuit, and an LED light engine power control circuit.

4. The traffic lamp of claim 3, wherein the digital device comprises one or more of a microcontroller, a counter, and a divider.

5. The traffic lamp of claim 3, wherein the clock source is configured to converts an LED current into a digital clock for the digital device.

6. The traffic lamp of claim 5, wherein the clock source comprises an amplitude and frequency monitor circuit and a level shifter circuit, wherein the amplitude and frequency monitor circuit is configured to ensure that a correct LED current level and/or frequency is met before producing an output signal and the level shifter circuit is configured to take an output signal from the amplitude and frequency monitor circuit and translate higher amplitudes to a compatible voltage level that is safe for the digital device.

7. The LED traffic lamp of claim 1, further comprising:

an LED voltage control circuit that is configured to control the power to the LED light engine to ensure proper operation of the traffic lamp where the traffic lamp is ON when it should be ON, OFF when it should be OFF and/or steady when it should be steady and wherein when unintentional flashing and/or failures within the traffic lamp lead to a wrong signal state, the LED voltage control circuit is further configured to turn OFF the LED light engine and place the traffic lamp in a safe state.

8. The traffic lamp of claim 7, further comprising a control stage that is configured to control a current level in the LED light engine through one or more LED drivers.

9. The traffic lamp of claim 7, wherein the safety flashing detector further comprises a digital device, a reset circuit, a clock source, a clock enable circuit, and an LED light engine power control circuit.

10. The traffic lamp of claim 9, wherein the digital device comprises one or more of a microcontroller, a counter, and a divider.

11. The traffic lamp of claim 9, wherein the clock source is configured to converts an LED current into a digital clock for the digital device.

12. The traffic lamp of claim 11, wherein the clock source comprises an amplitude and frequency monitor circuit and a level shifter circuit, wherein the amplitude and frequency monitor circuit is configured to ensure that a correct LED current level and/or frequency is met before producing an output signal and the level shifter circuit is configured to take an output signal from the amplitude and frequency monitor circuit and translate higher amplitudes to a compatible voltage level that is safe for the digital device.

* * * * *